US012721496B2

(12) United States Patent
Zheng et al.

(10) Patent No.: US 12,721,496 B2
(45) Date of Patent: Sep. 1, 2026

(54) WATER FLOW SYSTEM FOR WASHER, AND WASHER

(71) Applicant: Ningbo Fotile Kitchen Ware Co., Ltd., Ningbo (CN)

(72) Inventors: Feng Zheng, Ningbo (CN); Zhengshan Shi, Ningbo (CN); Jianjian Han, Ningbo (CN); Shuo Diao, Ningbo (CN); Benzhu Wei, Ningbo (CN); Yonglei Yao, Ningbo (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 324 days.

(21) Appl. No.: 18/712,486

(22) PCT Filed: Sep. 28, 2023

(86) PCT No.: PCT/CN2023/122634
§ 371 (c)(1),
(2) Date: Oct. 8, 2024

(87) PCT Pub. No.: WO2024/067814
PCT Pub. Date: Apr. 4, 2024

(65) Prior Publication Data

US 2025/0288180 A1 Sep. 18, 2025

(30) Foreign Application Priority Data

Sep. 30, 2022 (CN) ..... 202211216094.7

(51) Int. Cl.
*A47L 15/42* (2006.01)
*A47L 15/22* (2006.01)
(Continued)

(52) U.S. Cl.
CPC ..... *A47L 15/4225* (2013.01); *A47L 15/22* (2013.01); *F04D 29/4293* (2013.01); *F04D 29/448* (2013.01)

(58) Field of Classification Search
None
See application file for complete search history.

(56) References Cited

FOREIGN PATENT DOCUMENTS

CN 113520262 A * 10/2021 ..... A47L 15/428

OTHER PUBLICATIONS

CN113520262 translation (Year: 2021).*
Google Scholar and Google Patent search (Year: 2026).*

* cited by examiner

*Primary Examiner* — Rita P Adhlakha
(74) *Attorney, Agent, or Firm* — Wang Law Firm, Inc.

(57) ABSTRACT

A water flow system for a washer comprises a volute, a guide vane and a centrifugal impeller. The volute has a first water outlet and a second water outlet; the guide vane is disposed inside of the volute dividing the inner chamber into an upper chamber and a lower chamber; the first water outlet communicates with the upper chamber, the second water outlet communicates with the lower chamber, the guide vane has one or more water guide grooves at an outer edge of the guide vane for water to flow from the lower chamber into the upper chamber. The present invention has the guide vane for water diversion, one path of water is outputted through the first water outlet, and the other path of water is outputted through the second water outlet, the guide vane itself does not move, and under the diversion effect of the guide vane, the mutual interference of the two paths of water is eliminated, the energy loss of the water flows is reduced, and both the two paths of water can maintain a relatively high lift and a relatively large water flow.

28 Claims, 12 Drawing Sheets

(51) Int. Cl.
*F04D 29/42* (2006.01)
*F04D 29/44* (2006.01)

WATER FLOW SYSTEM FOR WASHER, AND WASHER

TECHNICAL FIELD OF THE INVENTION

The present invention relates to a field of dishwashers, and in particular to a water flow system for a washer, and a washer thereof.

BACKGROUND OF THE INVENTION

For a dishwasher with a large volume, at least two spraying arms are arranged vertically to achieve a better washing effect. During operation, a washing pump respectively delivers water to each spraying arm for spraying up and down, water falling back after rinsing dishes is gathered in a water cup at a bottom of the dishwasher, and the washing pump redelivers the falling-back water to each spraying arm, thereby completing one water flow cycle.

For example, a Chinese patent application CN106859563A (application No.: CN201611232345.5) entitled "Energy-Saving Dishwasher" disclosed a dishwasher, which comprises a chamber for placing and cleaning dishes, a spraying system for spraying water to clean the dishes, and a pump having a water pumping end and a water supply end for pumping water and supplying water to the spraying system; the spraying system is arranged in the chamber; the water pumping end of the pump communicates with the chamber, and the water supply end thereof communicates with the spraying system; the spraying system comprises an inner water pipe and two or more spraying devices being respectively arranged on the inner water pipe; the water supply end of the pump connects to a water diversion device, the water diversion device has two or more water outlets corresponding to the two or more spraying devices, and each spraying device communicates with corresponding water outlet; and during operation, one or more water outlets of the water diversion devices are opened according to an instruction, so that corresponding spray devices perform a cleaning operation.

In the described current dishwasher capable of performing bottom spraying and top spraying, the pump for supplying water to the spraying system is generally closed, that is, a volute of the washing pump is arranged below a box body, and a rotatable impeller is arranged in the volute; a water inlet of the volute of the pump communicates with a bottom of the washing chamber, a water outlet of the volute communicates to the water diversion device, and the water diversion device divides a water flow into a first branch for supplying water to a first spraying arm and a second branch for supplying water to a second spraying arm. Since the water for top water spraying and bottom water spraying are both independently powered by the washing pump, a lift, flow rate and impact force of the water flow on each branch of the water flow after the division are all greatly reduced, thereby affecting the cleaning effect.

In order to solve the above-stated problem, a prior Chinese patent CN214998275U (patent No.: ZL202023348766.9) entitled "Double Pumps System and Cleaning Machine Thereof" disclosed such a dual pumps system, which comprises: an upper impeller, a lower impeller, an upper housing, a lower housing and a driving member, wherein a first chamber for mounting an upper portion of a first vane is defined inside the upper housing, a second chamber for mounting a lower portion of the first vane is defined inside an upper portion of the lower housing; the lower housing has a first water inlet for supplying water into the second chamber at a side wall of the lower housing, the lower housing has a third chamber for installing the lower impeller at a lower portion of the lower housing, and the lower housing has a second water inlet and a water outlet at the side wall and/or a bottom wall of the lower housing. The above-stated dual pump system is an open system, in which the second chamber, the first chamber and the upper impeller supply water for bottom spraying, and the third chamber and the lower impeller supply water for top and/or a middle spraying. Since two paths of water flow are independently powered by corresponding pumps, a lift and water flow volume of each path of water flow are improved, thereby facilitating improvement of the cleaning effect.

However, since the independent upper impeller is used for bottom water spraying and the independent lower impeller is used for upper water spraying, the overall system is relatively complex and the production cost is high, and the water pumping effect cannot be ensured while reducing costs.

SUMMARY OF THE INVENTION

It is a first object of the present invention to provide two kinds of water flow system for a washer, which can separately provide a power for two paths of washing water, and improve the delivery lift and water flow so as to improve the cleaning effect, under the base of simplifying the structure and reducing costs.

It is a second object of the present invention to provide a washer using the above-stated water flow system.

For achieving the first object, a first kind of water flow system for a washer comprises a volute having an inner chamber, a top portion, an annular portion and a bottom portion; a guide vane disposed in the chamber of the volute dividing the inner chamber into an upper chamber and a lower chamber; a centrifugal impeller rotatably disposed in the lower chamber;

wherein, the volute has a water suction port at the bottom portion of the volute, a first water outlet at the top portion of the volute, and a second water outlet at the annular portion of the volute;

the first water outlet communicates with the upper chamber, the second water outlet communicates with the lower chamber, the guide vane has one or more water guide grooves at an outer edge of the guide vane for water to flow from the lower chamber into the upper chamber; and the centrifugal impeller sucks the water below the volute into the lower chamber through the water suction port, and then drains the water in the lower chamber into the upper chamber through the water guide grooves and then drains the water in the upper chamber out of the volute through the first water outlet; or the centrifugal impeller sucks the water below the volute into the lower chamber through the water suction port, and directly drains the water in the lower chamber out of the volute through the second water outlet.

Preferably, the guide vane comprises a circular cover plate and an annular side plate extending downwards from an edge of the cover plate, the side plate has an opening at a periphery of the side plate extending along a circumference of the cover plate, and the opening of the side plate faces the second water outlet, and the one or more water guide grooves are located at the side plate and pass through the cover plate. Under such design, the guide vane itself does not move, but the lower chamber which is capable of sucking and pressurizing water is defined upon the cover plate, the side plate and an inner wall of the volute enclosed together; and during rotation of the centrifugal impeller, a part of a water flow outputs from the annular portion of the volute through the second water outlet, and another part of the water flow passes through the water guide groove on the side plate to enter the upper chamber and then is transported upwards through the first water outlet at the top portion of the volute. The water flow system of the present invention diverts the water flow into two paths, and the diversion manner highly matches with the water drawing manner of the centrifugal impeller, which facilitates reduction of energy loss of the fluid and maintains a high spraying lift.

Preferably, the edge of the cover plate of the guide vane is adjacent to an inner wall of the volute to divide the inner chamber of the volute into the upper chamber and the lower chamber, the periphery of the side plate is close to the inner wall of the volute. Under such design, the guide vane and the inner wall of the volute are attached in a compact fit manner, thereby improving the assembly stability, avoiding interference caused to the water flow, and reducing energy loss of the fluid.

Preferably, the second water outlet has a first side edge and a second side edge, the side portion of the volute has a pressurizing surface spirally extending from the first side edge to the second side edge in a water flow direction, the opening of the side plate corresponds to the pressurizing surface, the pressurizing surface has a starting end and a tail end. The pressurizing surface pressurizes a water flow to be outputted through the second water outlet, so as to increase the water pressure and spraying lift of this part of water flow.

Preferably, the volute has a water outlet pipe respectively connected to a tail end of the pressurizing surface and to the second side edge of the second water outlet on the annular portion of the volute, the side plate has a first end and a second end, the first end of the side plate is arranged close to the starting end of the pressurizing surface, and the second end thereof is arranged close to the second side edge of the second water outlet, which facilitates further reduction of the energy loss of the water flow.

Preferably, the guide vane further comprises a flow guide piece extending downwards from the cover plate and arranged adjacent to an inner annular wall of the side plate, the flow guide piece is opposite the second water outlet on the circumference of the cover plate, a distance between an inner side wall of the flow guide piece and the centrifugal impeller increases gradually along the water flow direction, so that the flow guide piece has a pressurizing curved surface at the inner side wall of the guide piece for pressurizing the water to be drawn out through the second water outlet. Further, a tail end of the pressurizing curved surface is adjacent to a starting end of the pressurizing surface. The flow guide piece may cooperate with the pressurizing surface to conduct flow guide and pre-pressurization on the water flow to be outputted through the second water outlet before passing through the pressurizing surface, thereby further reducing the energy loss of the fluid, and increasing the water pressure and spraying lift of this part of water flow.

Preferably, the guide vane further comprises at least two flow guide pieces connected to an inner annular wall of the side plate and each spirally extending toward an edge of the centrifugal impeller in a direction opposite that of the water flow, and the at least two flow guide pieces are disposed at regular intervals in the circumferential direction of the side plate, the water guide groove being formed between two adjacent flow guide pieces. Such design can pressurize and guide the water flow on the circumference of the cover plate, a part of the water flow is pressurized in a circumferential direction and is then outputted through the second water outlet, which helps to increase the water pressure of this part of water flow; and after being pressurized in the circumferential direction and outputted through the water guide groove, the other part of water flow moves upward into the upper chamber at a relatively high flow rate, so as to be sprayed upward at a relatively high water pressure.

Preferably, the flow guide piece has a first end and a second end, the first end of the flow guide piece is connected to the side plate, and the second end of the flow guide piece is arranged adjacent to the edge of the centrifugal impeller, a distance between the inner side wall of each flow guide piece and the centrifugal impeller spirally increases from the second end of the flow guide piece to the first end of the flow guide piece. Such design enables water flow converging while implementing pressurization of the water flow, and maintains a relatively large water flow of the water flow at the water guide groove.

Preferably, the flow guide piece comprises a first flow guide piece and a second flow guide piece, the first flow guide piece is arranged adjacent to the second water outlet, the second flow guide piece is opposite the second water outlet on the circumference of the side plate, and a distance between a tail end of the first flow guide piece to the edge of the centrifugal impeller is smaller than a distance from a tail end of the second flow guide piece to the edge of the centrifugal impeller. The first flow guide piece and the second flow guide piece have the following functions: (1) the flow guide pieces cooperate with each other, to pressurize all water flows in the volute in the circumferential direction; (2) the second end of the first flow guide piece is used to divert water in the circumferential direction of the cover plate, so that a part of the water is outputted through the second water outlet, and the other part of the water continues to flow in the circumferential direction in the lower chamber along with the centrifugal impeller, and most of this part water is then transported to the first water outlet through the water guide groove; and (3) an inner wall of the second flow guide piece pressurizes the water to be outputted through the second water outlet.

Preferably, the flow guide piece further comprises a third flow guide piece, the third flow guide piece is located between the first flow guide piece and the second flow guide piece, the number of the water guide grooves is two and one of the two water guide grooves is formed between the first flow guide piece and the third flow guide piece, the other of the two water guide grooves is formed between the second flow guide piece and the third flow guide piece. Two water guide grooves are arranged at regular intervals along the direction of the water flow in the circumferential direction of the side plate, accordingly interference and energy loss of water flows can be reduced, and increasing the water pressure of the water flow outputted through the first water outlet.

Preferably, the second end of the side plate is smoothly connected to the tail end of the first flow guide piece through a smooth curved surface having a first end and a second end, the first end of the smooth curved surface and the tail end of the first flow guide piece form a flow diverting end for diverting water, the second end of the smooth curved surface is smoothly connected to the second side edge of the second water outlet. Such design can divert a water flow during circumferential flowing thereof, and reduce the energy loss of the fluid at diversion positions.

Preferably, the volute is cylinder-shaped, the centrifugal impeller is centered inside the volute, a lower volute chamber is defined between the flow guide piece and the inner wall of the volute, the centrifugal impeller is off center relative to the lower volute chamber, and the water guide groove is located closer to the centrifugal impeller and the lower volute chamber than the second water outlet to the centrifugal impeller and the lower volute chamber, that is, the water guide groove is located close to the centrifugal impeller and the lower volute chamber and the second water outlet is located far from the centrifugal impeller and the lower volute chamber. The centrifugal impeller is arranged in a middle in the volute, so as to maintain a high water pumping efficiency; in addition, the centrifugal impeller is off center relative to in the lower volute chamber, and the water guide groove is located adjacent to the centrifugal impeller and the lower volute chamber, so as to reduce interference and energy loss of water flow at the water guide groove, and increase the water pressure of the fluid entering the upper chamber; and the water guide groove is located closer to the centrifugal impeller and the lower volute chamber than the second water outlet to the centrifugal impeller and the lower volute chamber, to facilitate pressurization, by the flow guide pieces and the inner wall of the volute without the side plate, of the water flow to be outputted through the second water outlet.

Preferably, the upstream first end of the upstream flow guide piece and the downstream second end of the flow guide piece are staggered to form a water guide flow channel which communicates with the water guide groove, a water outlet end of the water guide flow channel is located at an inside of the side plate and communicates with a first side of the water guide groove. Further, a second side of the water guide groove has a flow guide slope located corresponding to the water outlet end of the water guide flow channel, and the flow guide slope having an upper end and a lower end gradually recedes away from the water outlet end of the water guide flow channel from bottom to top of the flow guide slope. Under such design, the interference and energy loss of the water flow moving upward through the water guide groove can be reduced, and the water flow flows smoothly, thereby having a high water pressure and high flow rate.

Preferably, a baffle extends upward from an upper surface of the cover plate, a converging flow channel is defined between the baffle and a top surface of the volute, the converging flow channel communicates with the water guide groove and gathers the water which is output upward from the first water outlet, an inner side wall of the converging flow channel is close to and smoothly connected to the upper end of the flow guide slope. Such design can further pressurize the water flow to be outputted through the first water outlet, and reduce the energy loss of the fluid when the water flow passes through a first edge of the water guide groove to the converging flow channel.

Preferably, a baffle extends upward from an upper surface of the cover plate, a converging flow channel is defined between the baffle and a top surface of the volute, the converging flow channel communicates with the water guide groove and gathers the water which is output upward from the first water outlet. Such design can pressurize the water flow to be outputted through the first water outlet.

Preferably, the volute has the first water outlet at a central portion of the top surface of the volute, the baffle comprises a circular arc segment arranged around an edge of the first water outlet, and a first curved surface segment extending smoothly from a first end of the circular arc segment to the first edge of the water guide groove, and a second curved surface segment extending smoothly from a second end of the circular arc segment to a second edge of the water guide groove. Such design further improves the flow converging effect, reduce the energy loss of the fluid, and increase the water pressure.

Preferably, the cover plate has a plurality of reinforcing ribs on an upper surface of the cover plate, the reinforcing ribs resist against a top surface of a pump housing and are connected to a periphery of the baffle.

Preferably, the water flow system further comprises a first spraying arm having a bottom end, a second spraying arm arranged above the first spraying arm, the first spraying arm has a water inlet and a water inlet sleeve extending downward from an edge of the water inlet, the volute has a water outlet sleeve extending upward from an edge of the first water outlet, and the water inlet sleeve is rotatably inserted into the water outlet sleeve. A water inlet end of the second spraying arm communicates with the second water outlet of the volute through a water delivery pipeline. The water flow system further comprises a driving member arranged below the volute, a power output shaft of the driving member passes through the water suction port to connect to the centrifugal impeller.

For achieving the second object, the washer, comprising a box body, the first spraying arm, the second spraying arm and the above-stated water flow system; wherein, the box body has a water-returning recess at a bottom portion of the box body, the recess has a top portion and a bottom portion, the top portion of the recess is covered with a filter plate, the volute is arranged inside the recess, a water suction gap is formed between the water suction port and the bottom portion of the recess, the first water outlet at the top portion of the volute is located above the filter plate and communicates with the water inlet of the first spraying arm, and the second spraying arm is arranged in an upper portion of the box body and communicates with the second water outlet of the volute through the water delivery pipeline.

For achieving the first object, a second kind of water flow system for a washer comprising a volute having an inner chamber and a centrifugal impeller for drawing water; wherein, the water flow system further comprises a guide vane, the volute has a water suction port at a bottom portion of the volute, a first water outlet at a top portion of the volute, and a second water outlet at an annular portion of the volute, the guide vane is arranged inside the volute and has a first flow guide channel capable of guiding a water to the first water outlet, and a second flow guide channel capable of guiding the water to the second water outlet.

Preferably, the guide vane comprises a cover plate transversely arranged in a middle of the volute, the guide vane divides the inner chamber of the volute into an upper chamber and a lower chamber independent from each other, the first flow guide channel passes through the lower chamber, an edge of the cover plate and the upper chamber, the second flow guide channel is formed inside the lower chamber.

Preferably, the cover plate is divided into at least a first portion and a second portion which are connected to each other, the edge of the cover plate is partially uncovered at a position corresponding to the first portion to form a water guide groove for the lower chamber to communicate with the upper chamber, and the water guide groove is a part of the first flow guide channel.

Preferably, at least two first flow guide pieces arranged to correspond to the first portion of the cover plate are located at a lower surface of the cover plate, a water guiding flow channel is defined between the two first flow guide pieces, the water guide groove is arranged corresponding to an outer end of the water guiding flow channel, and the water guiding flow channel, the water guide groove and the upper chamber together enclose the first flow guide channel.

Preferably, the second water outlet communicates with the lower chamber, and the second flow guide channel is formed between an edge of the second portion of the cover plate and the second water outlet.

Preferably, a second flow guide piece corresponding to the second portion of the cover plate is arranged on the lower surface of cover plate, and an outer end of the second flow guide piece is located within the edge of the cover plate, forming a water guiding outlet which communicates with the second water outlet.

Preferably, a first flow guide channel is defined upon the outer side of the first flow guide piece, the water guide groove, and the upper chamber enclosed together, and a second flow guide channel is defined between the outer side of the second flow guide piece and an inner wall of the volute enclosed together.

Compared with the prior art, in the first water flow system of the present invention, the guide vane capable of diverting water into two paths is arranged inside the volute, after diversion one path of water is outputted through the first water outlet at the top portion of the volute, and the other path of water is outputted through the second water outlet located at the annular portion of the volute; the guide vane itself does not move, and under the diversion effect of the guide vane, the mutual interference of the two paths of water is eliminated, the energy loss of the water flow is reduced, and both the two paths of water can maintain a relatively high delivery lift and a relatively large water flow. In the present invention, operation of the water flow system can be completed only by one centrifugal impeller, and the whole system is simple and the production cost is reduced; in addition, the present invention using open water flow system, which facilitates disassembling and assembling and cleaning of the water flow system.

Compared with the prior art, in the second water flow system of the present invention, under the design of the guide vane, the first flow guide channel and the second flow guide channel for water diversion are formed inside the volute, and under the diversion effect of the guide vane, the mutual interference of two paths of water is eliminated. The second water flow system of the present invention also has the technical effects described in the previous paragraph.

DETAILED DESCRIPTION OF THE INVENTION

The present invention will be further described below in detail by embodiments with reference to the accompanying drawings.

Embodiment 1

Figure 12:
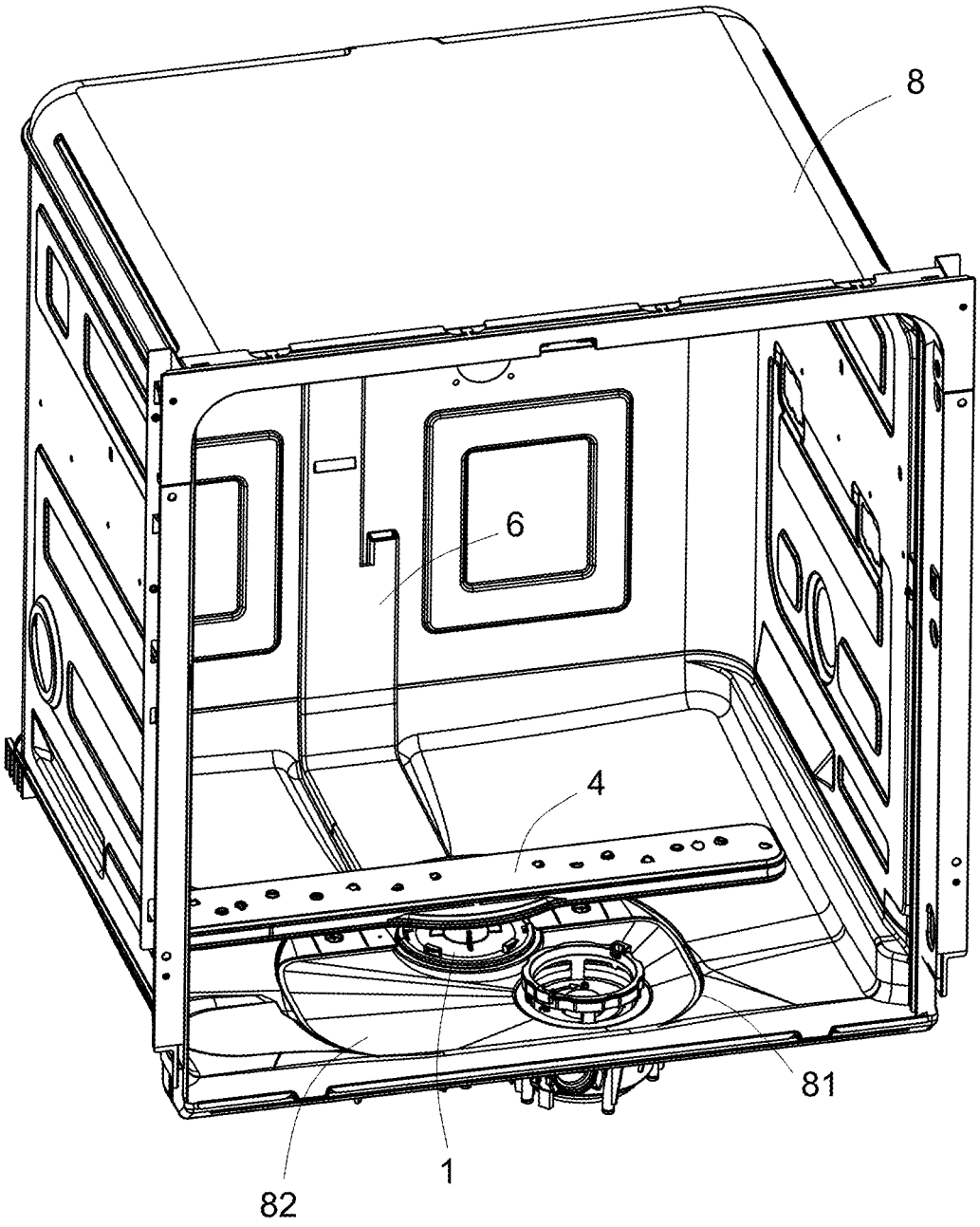
FIG. 12 is a perspective view of a washer according to Embodiment 1 of the present invention.

FIGS. 1-11 show a first preferred embodiment of the water flow system of the present invention. FIG. 12 shows a washer using the water flow system of the present invention, in which the water flow system sprays water columns through a first spraying arm 4 and a second spraying arm 5 for cleaning dishes.

As shown in FIGS. 1-11, the water flow system of this embodiment comprises a volute 1 having an inner chamber, a top portion, an annular portion and a bottom portion, a guide vane 2 and a centrifugal impeller 3 for drawing water.

the volute 1 has a water suction port 13 at the bottom portion of the volute 1, a first water outlet 11 at the top portion of the volute 1, and a second water outlet 12 at the annular portion of the volute 1.

The guide vane 2 is arranged inside the volute 1 and has a first flow guide channel G1 capable of guiding a water to the first water outlet 11, and a second flow guide channel G2 capable of guiding the water to the second water outlet 12. the guide vane 2 comprises a cover plate 24 transversely arranged in a middle of the volute 1, the guide vane 2 divides the inner chamber of the volute 1 into an upper chamber 21 and a lower chamber 22 independent from each other, the first flow guide channel G1 passes through the lower chamber 22, an edge of the cover plate 24 and the upper chamber 21, the second flow guide channel G2 is formed inside the lower chamber 22; and the first water outlet 11 communicates with the upper chamber 21, the guide vane 2 has one or more water guide grooves 23 at an outer edge of the guide vane 2 for water to flow from the lower chamber 22 into the upper chamber 21; specifically, the cover plate 24 is divided into at least a first portion and a second portion which are connected to each other, the edge of the cover plate 24 is partially uncovered at a position corresponding to the first portion to form a water guide groove 23 for the lower chamber 22 to communicate with the upper chamber 21, and the water guide groove 23 is a part of the first flow guide channel G1; at least two first flow guide pieces 261 arranged to correspond to the first portion of the cover plate 24 are located at a lower surface of the cover plate 24, a water guiding flow channel is defined between the two first flow guide pieces 261, the water guide groove 23 is arranged corresponding to an outer end of the water guiding flow channel, and the water guiding flow channel, the water guide groove 23 and the upper chamber 21 together enclose the first flow guide channel G1; a plurality of flow guide pieces 26 are arranged at regular intervals on the circumference of the first portion 201 of the cover plate 24, and extend downwards from the cover plate 24 and arranged adjacent to an inner annular wall of the side plate 25, an encircling chamber 100 is defined upon the flow guide pieces 26 and the inner all the lower portion of the volute 1 enclosed together for pressurizing and secondary diversion of the water flow; the second water outlet 12 communicates with the lower chamber 22, and the second flow guide channel G2 is formed between an edge of the second portion of the cover plate 24 and the second water outlet 12.

The centrifugal impeller 3 sucks the water below the volute 1 into the lower chamber 22 through the water suction port 13, and then drains the water in the lower chamber 22 into the upper chamber 21 through the water guide grooves 23 and then drains the water in the upper chamber 21 out of the volute 1 through the first water outlet 11, or the centrifugal impeller 3 sucks the water below the volute 1 into the lower chamber 22 through the water suction port 13, and directly drains the water in the lower chamber 22 out of the volute 1 through the second water outlet 12.

The guide vane 2 comprises a circular cover plate 24 and an annular side plate 25 extending downwards from an edge of the cover plate 24, the side plate 25 has an opening 251 at a periphery of the side plate 25 extending along a circumference of the cover plate 24, and the opening 251 of the side plate 25 faces the second water outlet 12, and the one or more water guide grooves 23 are located at the side plate 25 and pass through the cover plate 24. The edge of the cover plate 24 of the guide vane 2 is adjacent to an inner wall of the volute 1 to divide the inner chamber of the volute 1 into the upper chamber 21 and the lower chamber 22, the periphery of the side plate 25 is close to the inner wall of the volute 1, so as to connect the guide vane 2 and the inner wall of the volute 1 in a compact fit manner, thereby improving the assembly stability, avoiding interference caused to the water flow, and reducing energy loss of the fluid. In this embodiment, the guide vane 2 itself does not move, but a lower chamber 22 for sucking and pressurizing water is defined upon the cover plate 24, the side plate 25 and the inner wall of the volute 1 enclosed together; and during rotation of the centrifugal impeller 3, a part of a water flow outputs from the annular portion of the volute 1 through the second water outlet 12, and another part of the water flow passes through the water guide groove 13 on the side plate 25 to enter the upper chamber 21 and then is transported upwards through the first water outlet 11 at the top portion of the volute 1. The water flow system in this embodiment diverts the water flow into two paths, and the diversion manner highly matches with the water drawing manner of the centrifugal impeller 3, which facilitates reduction of energy loss of the fluid and maintains a high spraying lift.

In this embodiment, the second water outlet 12 has a first side edge 121 and a second side edge 122, the side portion of the volute 1 has a pressurizing surface 14 spirally extending from the first side edge 121 to the second side edge 122 in a water flow direction, the opening 251 of the side plate 25 corresponds to the pressurizing surface 14, the pressurizing surface 14 has a starting end and a tail end. The pressurizing surface 14 pressurizes a water flow to be outputted through the second water outlet 12, so as to increase the water pressure and spraying lift of this part of water flow. the volute 1 has a water outlet pipe 15 respectively connected to a tail end of the pressurizing surface 14 and to the second side edge 122 of the second water outlet 12 on the annular portion of the volute 1, the side plate 25 has a first end and a second end, the first end of the side plate 25 is arranged close to the starting end of the pressurizing surface 14, and the second end thereof is arranged close to the second side edge 122 of the second water outlet 12, which further reduces the energy loss of the water flow.

In this embodiment, the guide vane 2 further comprises at least three flow guide pieces 26 connected to an inner annular wall of the side plate 25 and each spirally extending toward an edge of the centrifugal impeller 3 in a direction opposite that of the water flow, and the at least three flow guide pieces 26 are disposed at regular intervals in the circumferential direction of the side plate 25, the water guide groove 23 being formed between two adjacent flow guide pieces 26. Such design can pressurize and guide the water flow on the circumference of the cover plate 24, a part of the water flow is pressurized in a circumferential direction and is then outputted through the second water outlet 12, which helps to increase the water pressure of this part of water flow; and after being pressurized in the circumferential direction and outputted through the water guide groove 13, the other part of water flow moves upward into the upper chamber 21 at a relatively high flow, so as to be sprayed upward at a relatively high water pressure. The flow guide piece 26 has a first end and a second end, the first end of the flow guide piece 26 is connected to the side plate 25, and the second end of the flow guide piece 26 is arranged adjacent to the edge of the centrifugal impeller 3, a distance between the inner side wall of each flow guide piece 26 and the centrifugal impeller 3 spirally increases from the second end of the flow guide piece 26 to the first end of the flow guide piece 26. Such design enables water flow converging while implementing pressurization of the water flow, and maintains a relatively large water flow at the water guide groove 23.

In this embodiment, the flow guide piece 26 comprises a first flow guide piece 261, a second flow guide piece 262, and a third flow guide piece 263, the first flow guide piece 261 is arranged adjacent to the second water outlet 12, the second flow guide piece 262 is opposite the second water outlet 12 on the circumference of the side plate 25, and a distance between a tail end of the first flow guide piece 261 to the edge of the centrifugal impeller 3 is smaller than a distance from a tail end of the second flow guide piece 262 to the edge of the centrifugal impeller 3; the third flow guide piece 263 is located between the first flow guide piece 261 and the second flow guide piece 262, the number of the water guide grooves 23 is two and one of the two water guide grooves 23 is formed between the first flow guide piece 261 and the third flow guide piece 263, the other of the two water guide grooves 23 is formed between the second flow guide piece 262 and the third flow guide piece 263. The flow guide pieces 26 have the following functions: (1) the first flow guide piece 261, the second flow guide piece 262 and the third flow guide piece 263 cooperate with each other, to pressurize all water flows in the volute 1 in the circumferential direction; (2) the second end of the first flow guide piece 261 is used to divert water in the circumferential direction, so that a part of the water is outputted through the second water outlet 12, and the other part of the water continues to flow in the circumferential direction in the lower chamber 22 along with the centrifugal impeller 3, and most of this part water is transported to the first water outlet 11 through the water guide groove 23; (3) the inner wall of the second flow guide piece 262 pressurizes the water to be outputted through the second water outlet 12; and (4) two water guide grooves 23 are enclosed by the flow guide pieces, and the two water guide grooves 23 are arranged at regular intervals along the direction of the water flow in the circumferential direction of the side plate 25, thereby reducing interference and energy loss of water flows, and increasing the water pressure of the water flow outputted through the first water outlet 11.

The second flow guide piece 262 is opposite the second water outlet 12 on the circumference of the side plate 25, and a distance between an inner side wall of the flow guide piece 26 and the centrifugal impeller 3 increases gradually along the water flow direction, so that the flow guide piece 26 has a pressurizing curved surface 2621 at the inner side wall of the guide piece 26 for pressurizing the water to be drawn out through the second water outlet 12. A tail end of the pressurizing curved surface 2621 is adjacent to a starting end of the pressurizing surface 14. The second flow guide piece 262 cooperates with the pressurizing surface 14 to conduct flow guide and pre-pressurization on the water flow to be outputted through the second water outlet 12 before passing through the pressurizing surface 14, thereby further reducing the energy loss of the fluid, and increasing the water pressure and spraying lift of this part of water flow.

The second end of the side plate 25 is smoothly connected to the tail end of the first flow guide piece 261 through a smooth curved surface 264 having a first end and a second end, the first end of the smooth curved surface 264 and the tail end of the first flow guide piece 261 form a flow diverting end 265 for diverting water, the second end of the smooth curved surface 264 is smoothly connected to the second side edge 122 of the second water outlet 12. Such design can divert a water flow during circumferential flowing thereof, and reduce the energy loss of the fluid at diversion positions.

It should be noted that, the number of the flow guide pieces 26 is at least two, and in this embodiment, three flow guide pieces are arranged for illustration; and certainly, the number of the flow guide pieces 26 may be more than three, and the number of the flow guide pieces 26 may be set according to water flow distribution.

In this embodiment, the volute 1 is cylinder-shaped, the centrifugal impeller 3 is centered inside the volute 1, a lower volute chamber 260 is defined between the flow guide piece 26 and the inner wall of the volute 1, the centrifugal impeller 3 is off center relative to the lower volute chamber 260, and the water guide groove 23 is located closer to the centrifugal impeller 3 and the lower volute chamber 260 than the second water outlet 12 to the centrifugal impeller 3 and the lower volute chamber 260, that is, the water guide groove is located close to the centrifugal impeller and the lower volute chamber and the second water outlet is located far from the centrifugal impeller and the lower volute chamber. The centrifugal impeller 3 is arranged in the middle in the volute 1, so as to maintain a high water pumping efficiency; in addition, the centrifugal impeller 3 is off center relative to the lower volute chamber 260, and the water guide groove 23 is located adjacent to the centrifugal impeller 3 and the lower volute chamber 260, so as to reduce interference and energy loss of water flows at the water guide groove 23, and increase the water pressure of the fluid entering the upper chamber 21; and the water guide groove 23 is located closer to the centrifugal impeller 3 and the lower volute chamber 260 than the second water outlet 12 to the centrifugal impeller 3 and the lower volute chamber 260, to facilitate pressurization, by the flow guide pieces 26 and the inner wall of the volute 1 without the side plate 25, of the water flow to be outputted through the second water outlet 12.

In this embodiment, the upstream first end of the upstream flow guide piece 26 and the downstream second end of the flow guide piece 26 are staggered to form a water guide flow channel 231 which communicates with the water guide groove 23, a water outlet end of the water guide flow channel 231 is located at an inside of the side plate 25 and communicates with a first side of the water guide groove 23. A second side of the water guide groove 23 has a flow guide slope 232 located corresponding to the water outlet end of the water guide flow channel 231, and the flow guide slope 232 having an upper end and a lower end gradually recedes away from the water outlet end of the water guide flow channel 231 from bottom to top of the flow guide slope 232. Under such design, the interference and energy loss of the water flows moving upward through the water guide groove 23 can be reduced, and the water flows are maintained to flow smoothly, thereby having a high water pressure and high flow rate.

A baffle 27 extends upward from an upper surface of the cover plate 24, a converging flow channel 270 is defined between the baffle 27 and a top surface of the volute 1, the converging flow channel 270 communicates with the water guide groove 23 and gathers the water which is output upward from the first water outlet 11, an inner side wall of the converging flow channel 270 is close to and smoothly connected to the upper end of the flow guide slope 232. Such design can further pressurize the water flow to be outputted through the first water outlet 11, and reduce the energy loss of the fluid when the water flow passes through a first edge of the water guide groove 23 to the converging flow channel 270.

The baffle 27 and the converging flow channel 270 are used to pressurize the water flow to be outputted through the first water outlet 11. The volute 1 has the first water outlet 11 at a central portion of the top surface of the volute 1, the baffle 27 comprises a circular arc segment 271 arranged around an edge of the first water outlet 11, and a first curved surface segment 272 extending smoothly from a first end of the circular arc segment 271 to the first edge of the water guide groove 23, and a second curved surface segment 273 extending smoothly from a second end of the circular arc segment to a second edge of the water guide groove 23. Such design further improves the flow converging effect, reduces the energy loss of the fluid, and increases the water pressure.

In this embodiment, the baffle 27 further comprises a third curved surface segment 274 between the first curved surface segment 272 and the second curved surface segment 273, and the third curved surface segment 274 is used to divide the converging flow channel 270 into diversion channels each corresponding to one water guide groove 23. An outer end of the third curved surface segment 274 is connected to the flow guide slope 232 at an upper end of the third flow guide piece 263, and an inner end of the third curved surface segment 274 is located adjacent to an opening of the circular arc segment 271; and the two diversion channels converge before entering the opening of the circular arc segment 271, so as to guide and converge the water flows, thereby reducing the interference and energy loss of the water flows.

Figure 13:
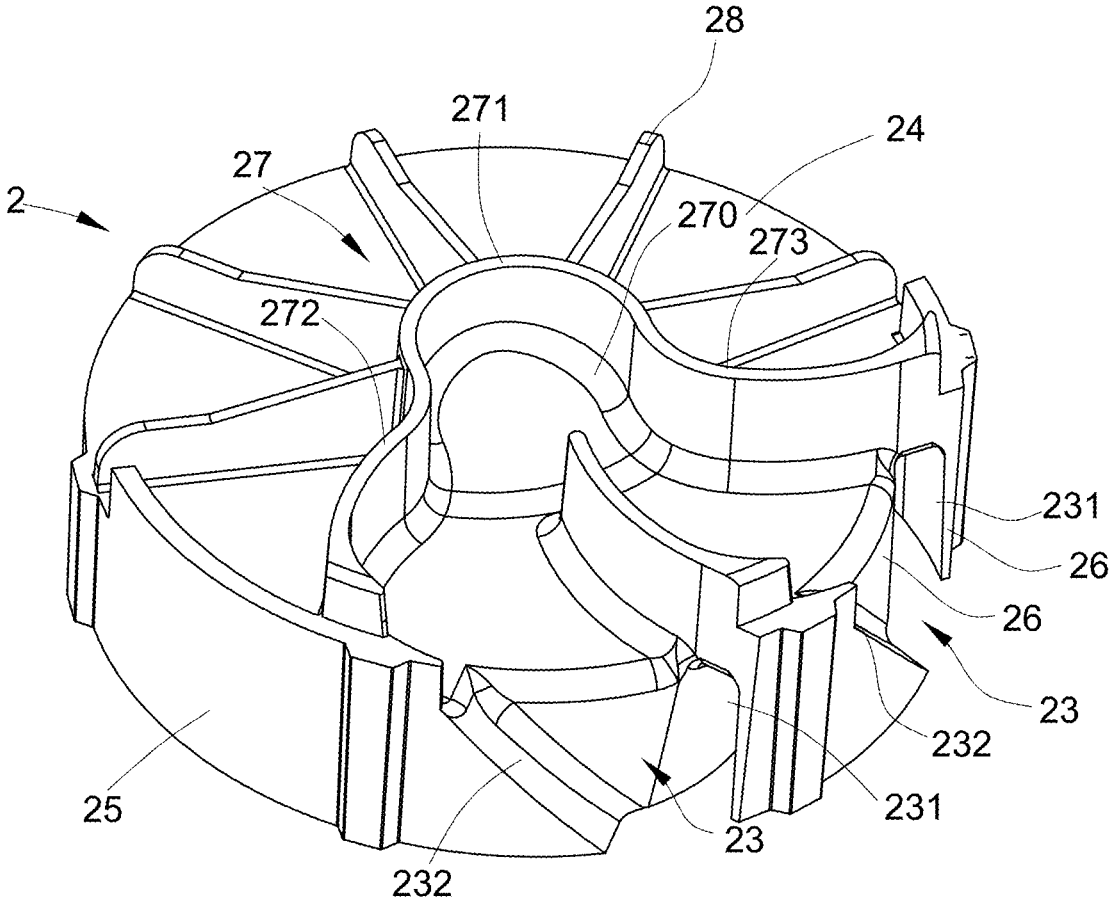
FIG. 13 is a perspective view of another kind of guide vane.

Another kind of the cover plate 24 is shown in FIG. 13, the cover plate 24 has a plurality of reinforcing ribs 28 on an upper surface of the cover plate 24, the reinforcing ribs 28 resist against a top surface of a pump housing and are connected to a periphery of the baffle 27, so as to improve the reliability after assembly and during use.

The water flow system in this embodiment further comprises the water flow system further comprises a first spraying arm 4 having a bottom end and a second spraying arm 5 arranged above the first spraying arm 4, the first spraying arm 4 has a water inlet 41 and a water inlet sleeve 42 extending downward from an edge of the water inlet 41, the volute 1 has a water outlet sleeve 16 extending upward from an edge of the first water outlet 11, and the water inlet sleeve 42 is rotatably inserted into the water outlet sleeve 16; and a water inlet end of the second spraying arm 5 communicates with the second water outlet 12 of the volute 1 through a water delivery pipeline 6. The water flow system in this embodiment further comprises a driving member 7 arranged below the volute 1, a power output shaft 71 of the driving member 7 passes through the water suction port 13 to connect to the centrifugal impeller 3.

Figure 1:
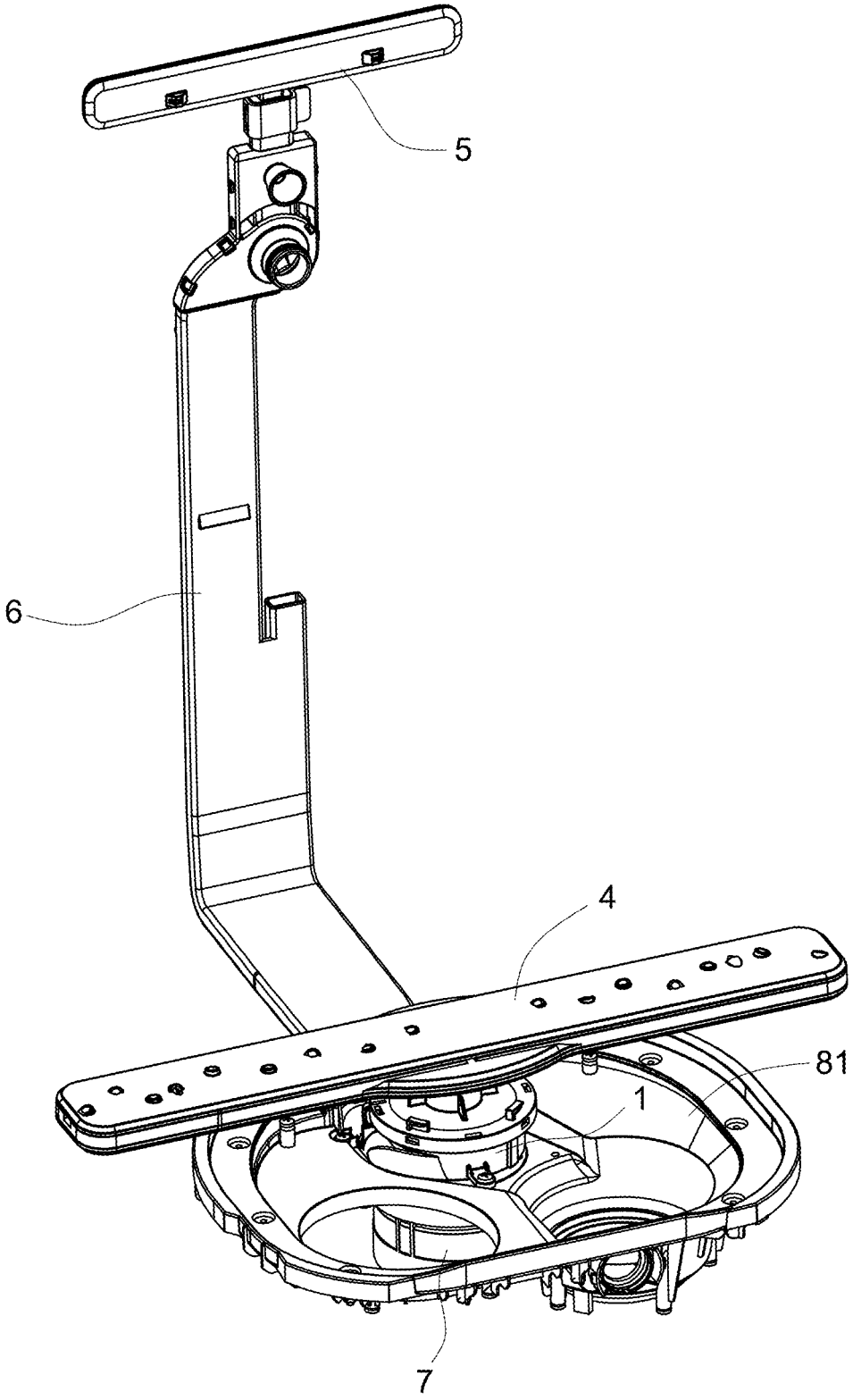
FIG. 1 is a perspective view of a water flow system (comprising a water-returning recess) according to Embodiment 1 of the present invention.
Figure 2:
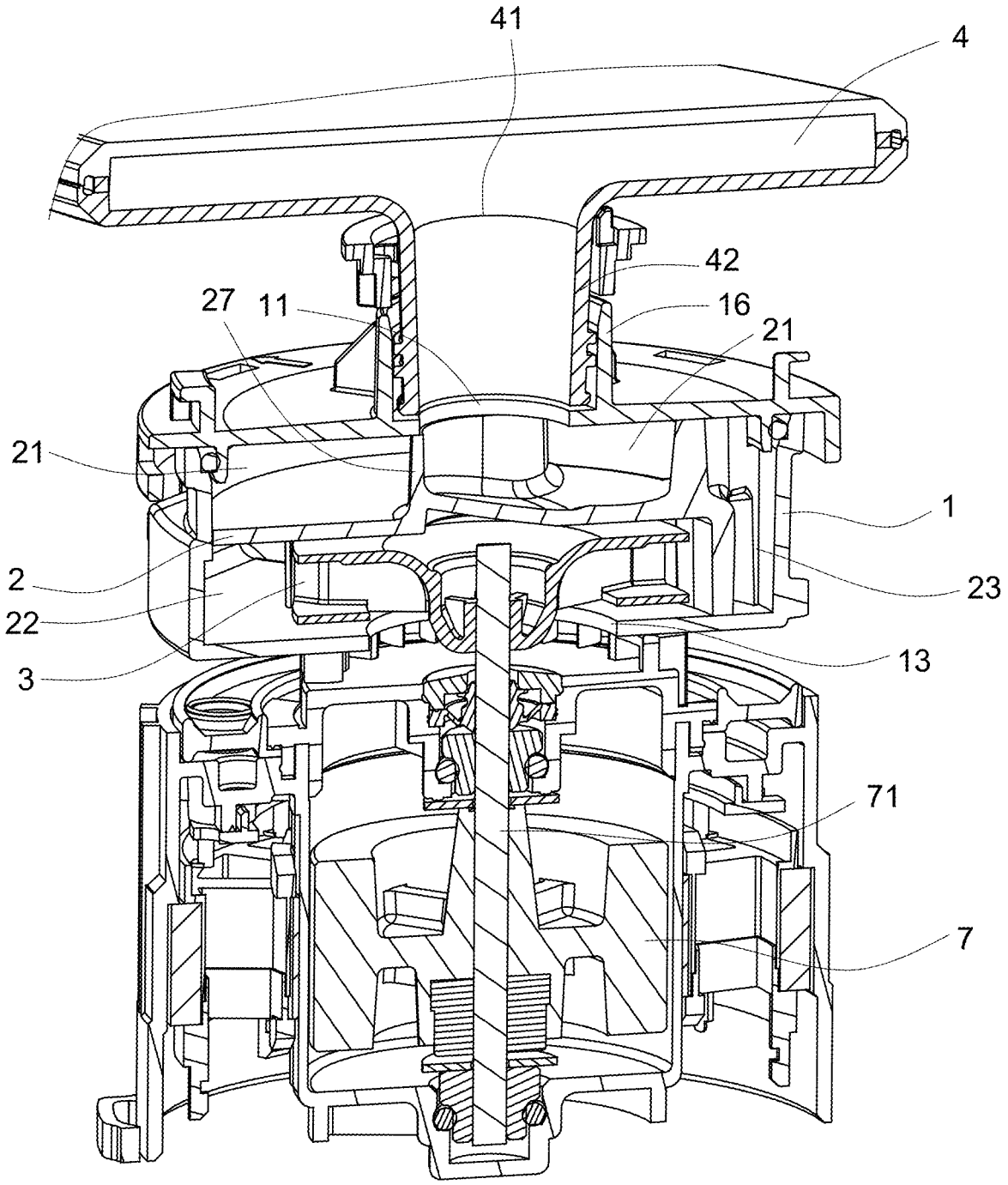
FIG. 2 is a vertical sectional view of a part of the water flow system in FIG. 1.
Figure 3:
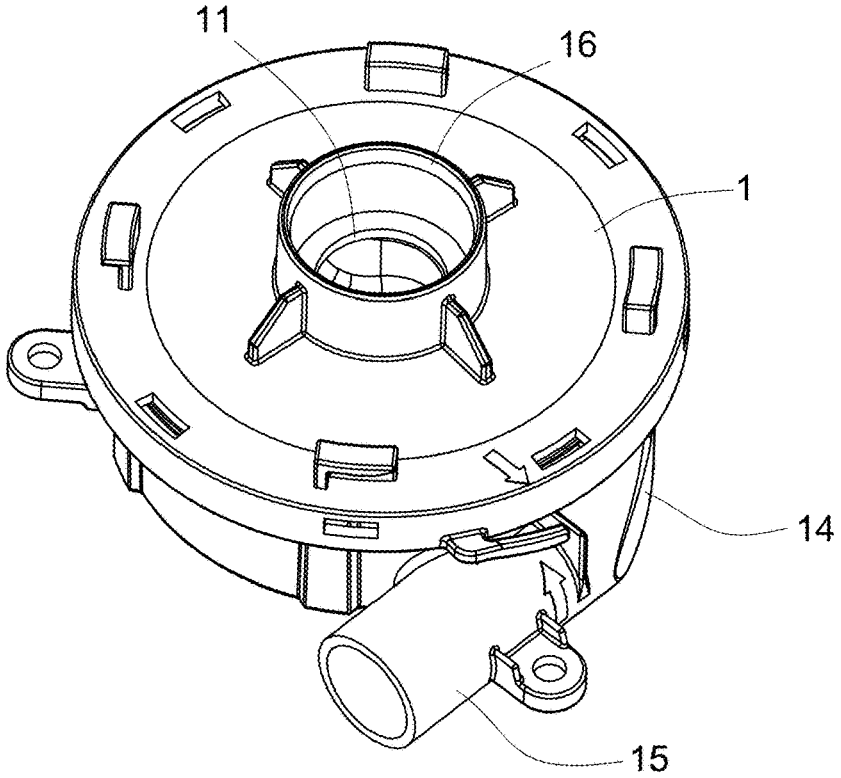
FIG. 3 is a perspective view of a volute, a centrifugal impeller and a guide vane mounted together.
Figure 4:
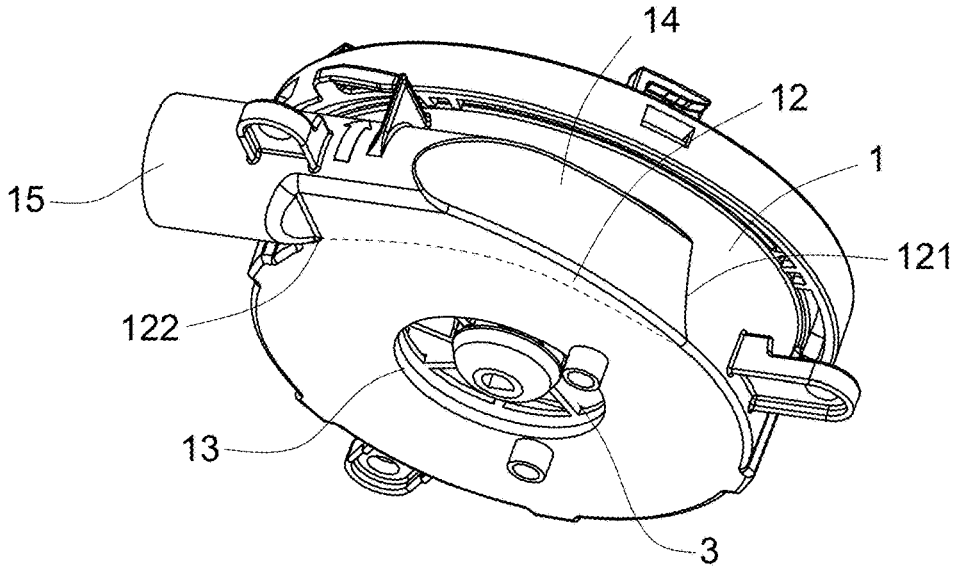
FIG. 4 is another perspective view of FIG. 3.
Figure 5:
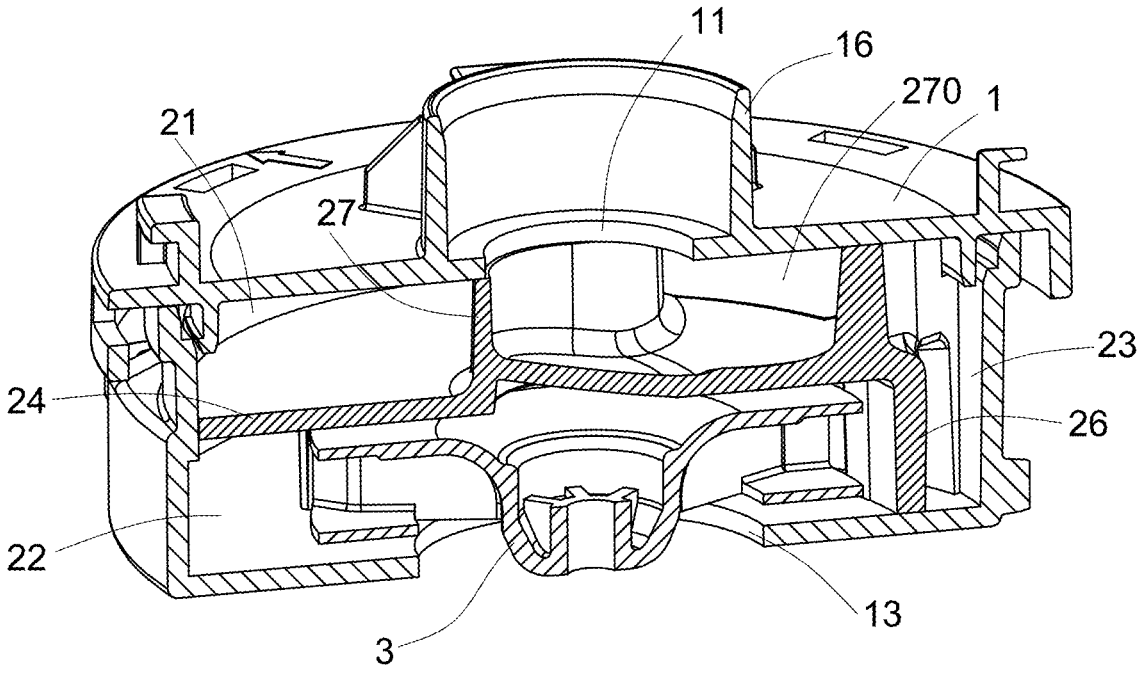
FIG. 5 is a vertical sectional view of FIG. 3.
Figure 6:
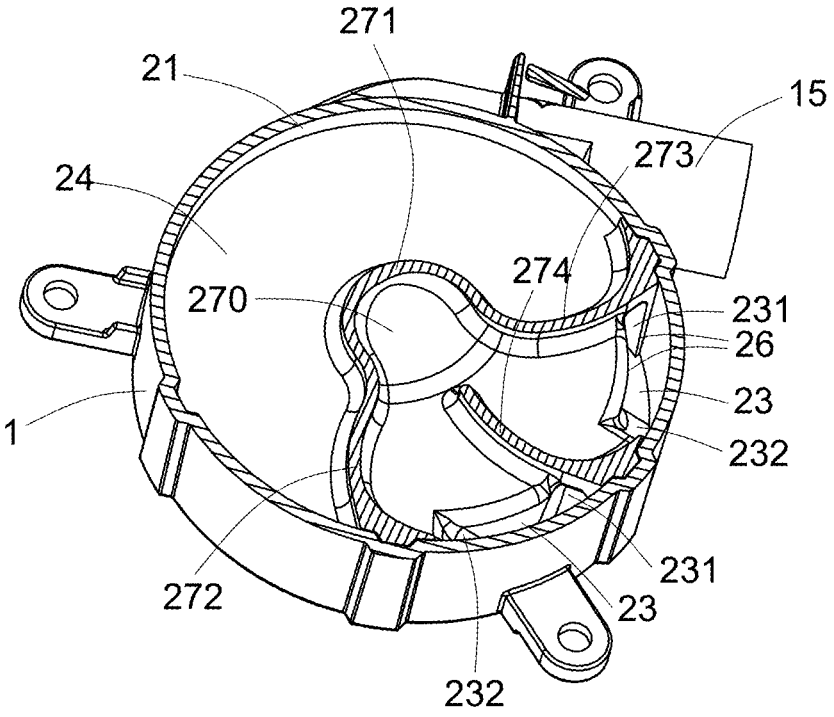
FIG. 6 is a transverse sectional view of FIG. 3 (showing the components in an upper chamber)
Figure 7:
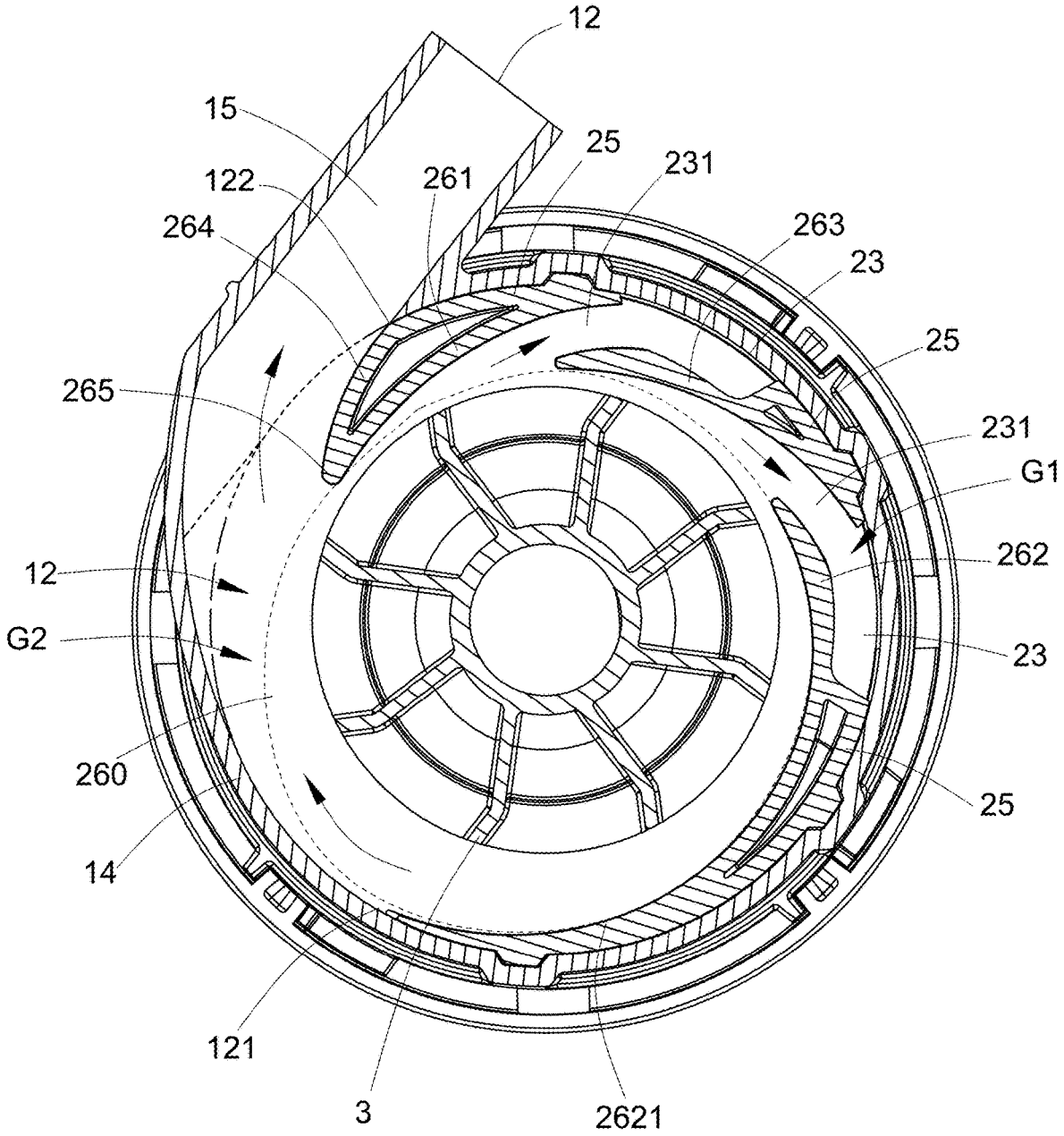
FIG. 7 is another transverse sectional view of FIG. 3 (showing the components in a lower chamber)
Figure 8:
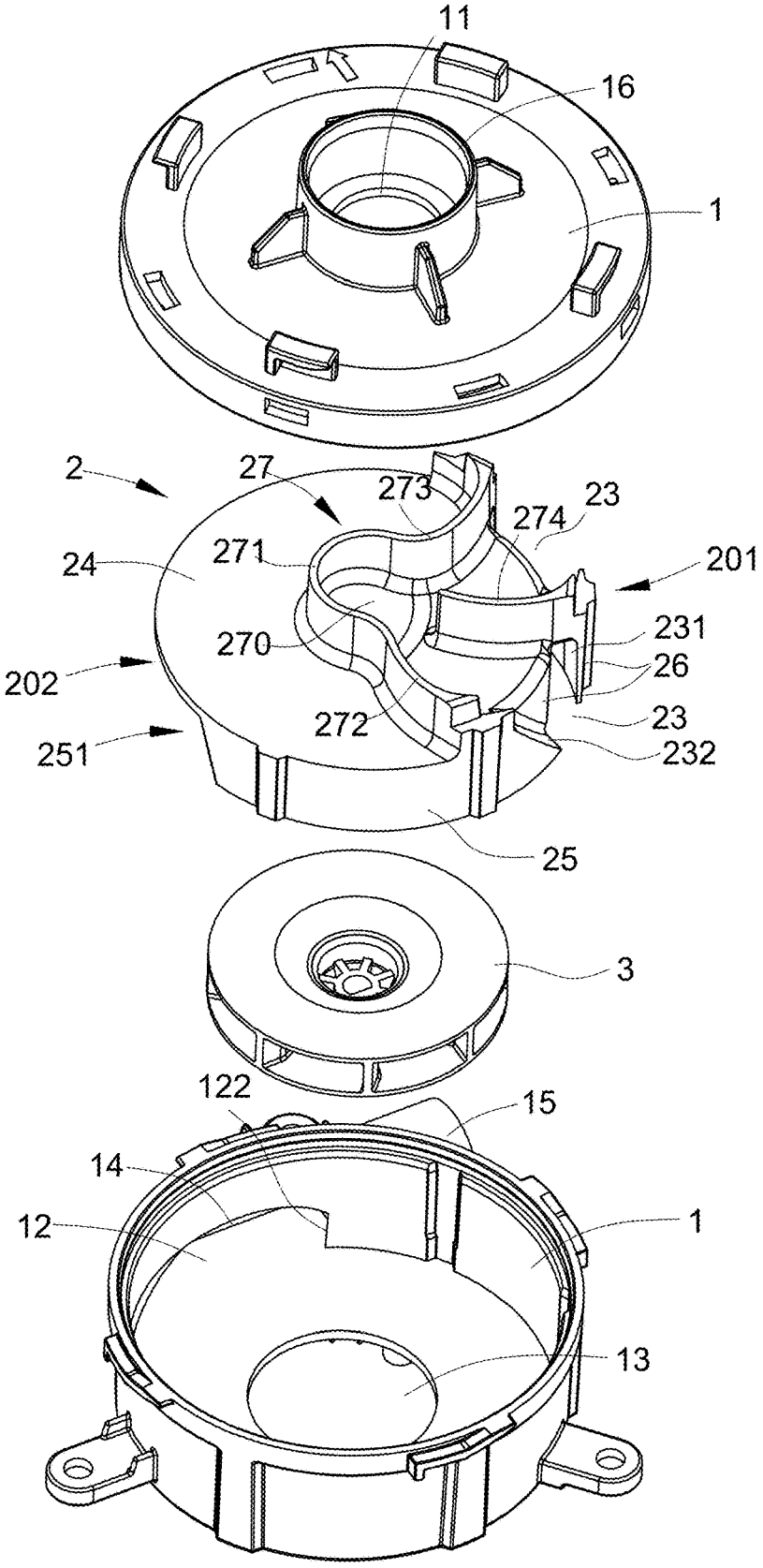
FIG. 8 is an exploded view of FIG. 3.
Figure 9:
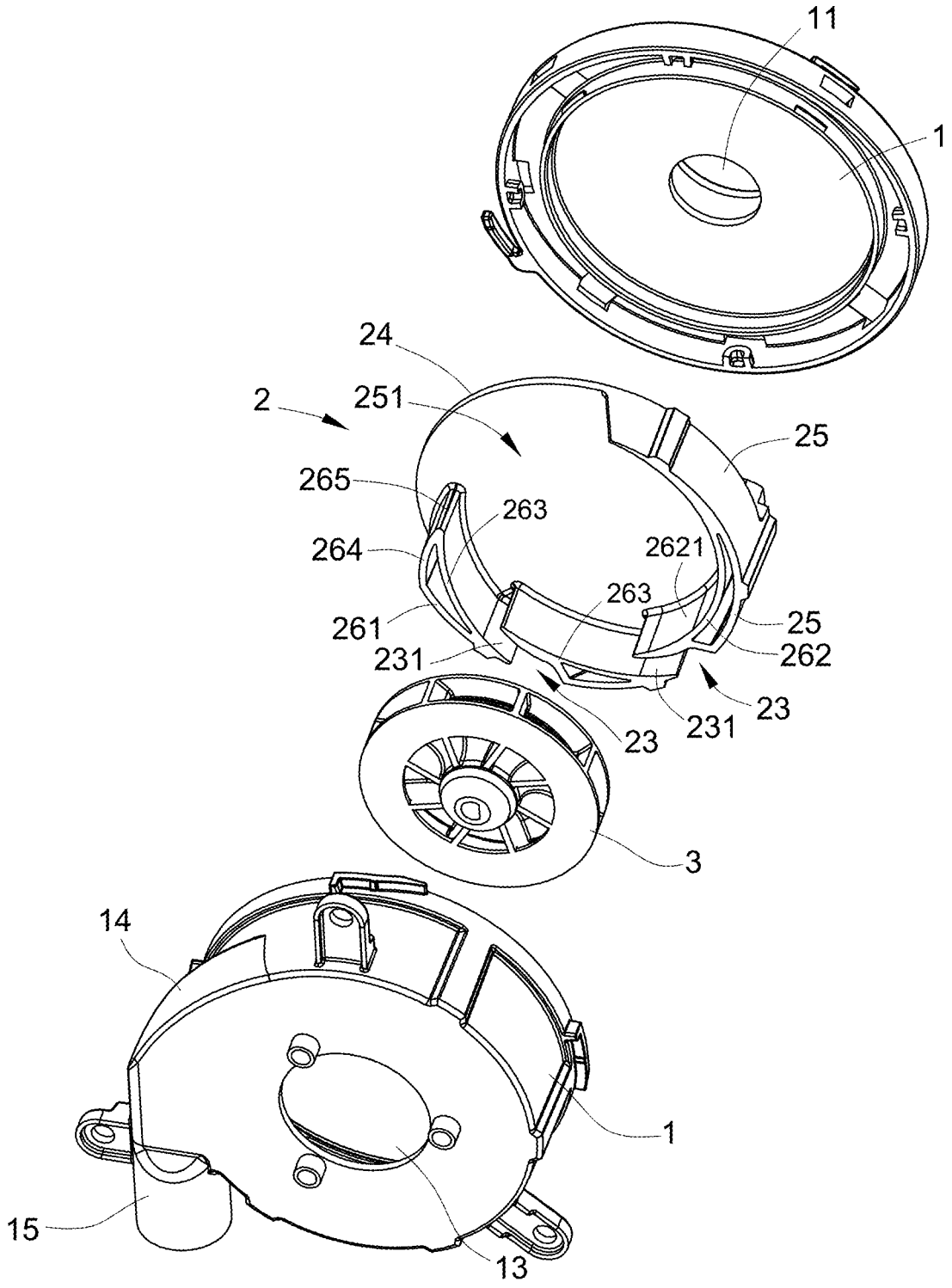
FIG. 9 is a perspective view of FIG. 8 seen from a bottom of the volute.
Figure 10:
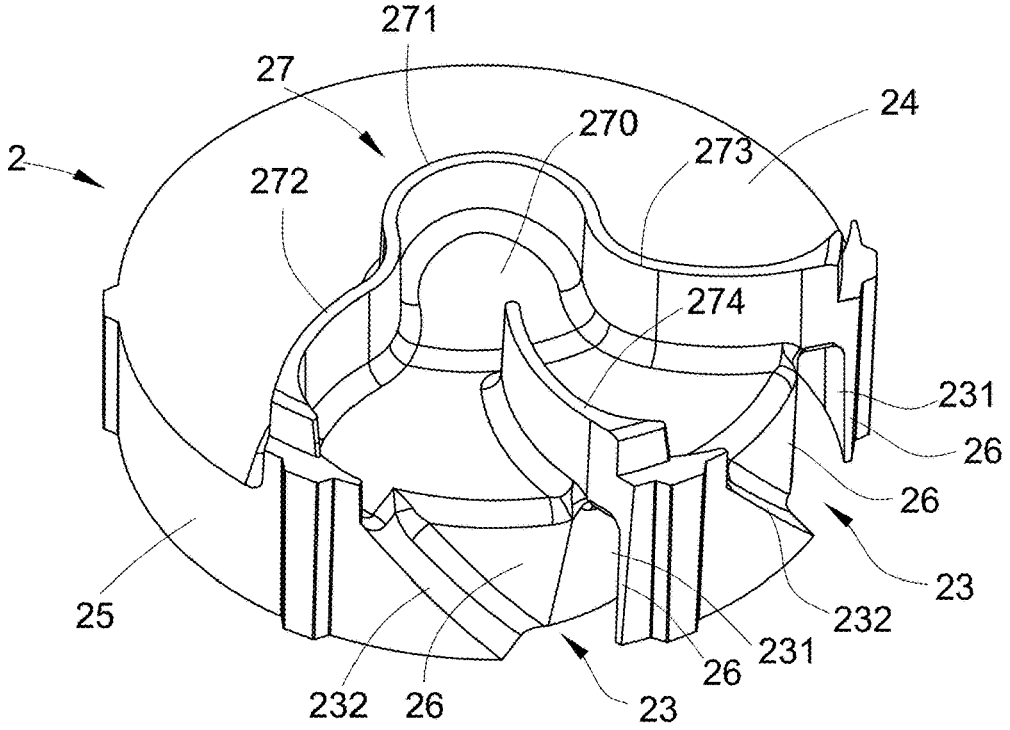
FIG. 10 is a perspective view of the guide vane according to Embodiment 1 of the present invention.
Figure 11:
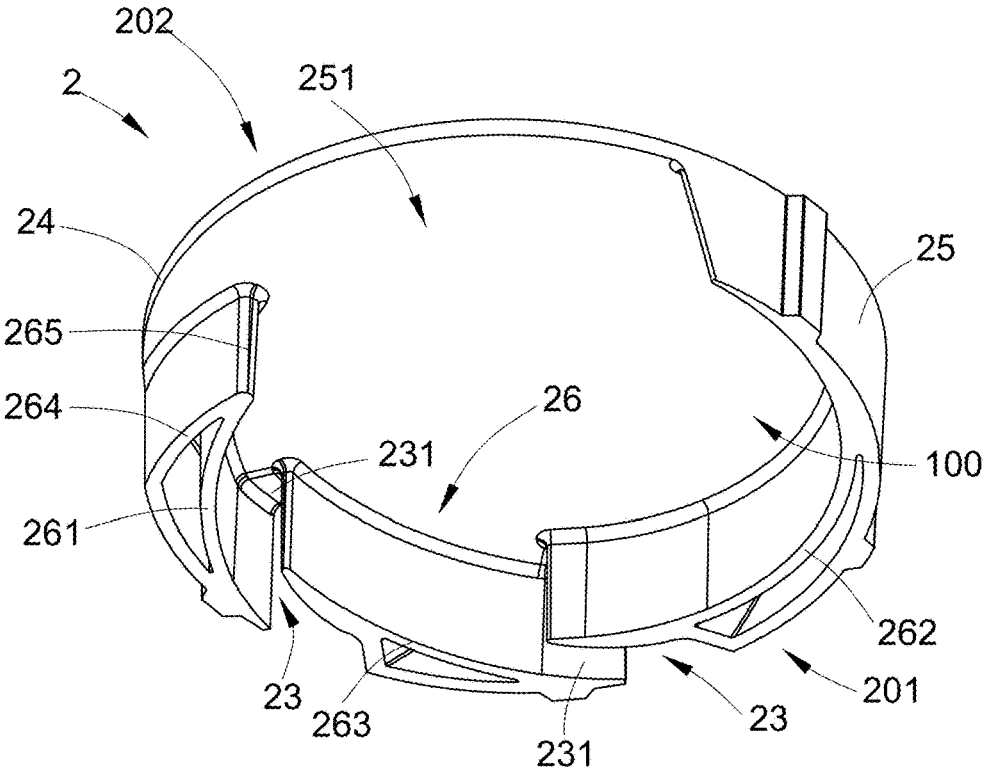
FIG. 11 is another perspective view of the guide vane seen from a bottom of the guide vane according to Embodiment 1 of the present invention.

As shown in FIGS. 1 and 12, the washer in this embodiment comprises a box body 8, the first spraying arm 4, the second spraying arm 5 and the water flow system of claim 21; wherein, the box body 8 has a water-returning recess 81 at a bottom portion of the box body 8, the recess 81 has a top portion and a bottom portion, the top portion of the recess 81 is covered with a filter plate 82, the volute 1 is arranged inside the recess 81, a water suction gap is formed between the water suction port 13 and the bottom portion of the recess 81, the first water outlet 11 at the top portion of the volute 1 is located above the filter plate 82 and communicates with the water inlet 41 of the first spraying arm 4, and the second spraying arm 5 is arranged in an upper portion of the box body 8 and communicates with the second water outlet 12 of the volute 1 through the water delivery pipeline 6.

In this embodiment, the volute 1 has the guide vane 2 for water diversion, so as to divert the water inside the volute 1 into two channels, i.e. the first flow guide channel G1 and the second flow guide channel G2, after diversion one path of water is outputted through the first water outlet 11 at the top portion of the volute 1, and the other path of water is outputted through the second water outlet 12 at the annular portion of the volute 1; the guide vane 2 itself does not move, and under the diversion effect of the guide vane 2, the mutual interference of the two paths of water is eliminated, the energy loss of the water flows is reduced, and both the two paths of water can maintain a relatively high delivery lift and a relatively large water flow. In this embodiment, operation of the water flow system can be completed only by one centrifugal impeller 3, and the whole system is simple and the production cost is reduced.

Embodiment 2

Figure 14:
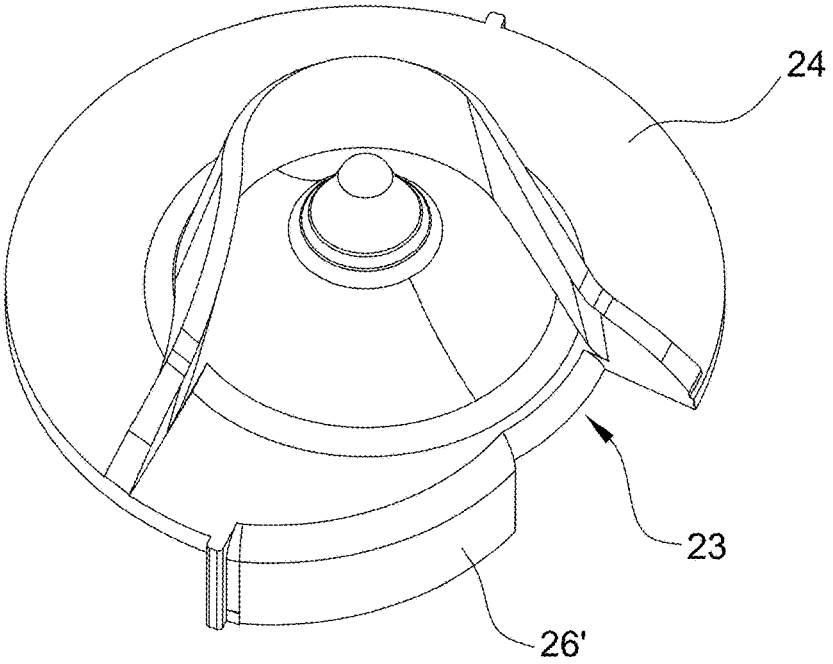
FIG. 14 is a perspective view of flow guide pieces on the cover plate according to Embodiment 2 of the present invention.
Figure 15:
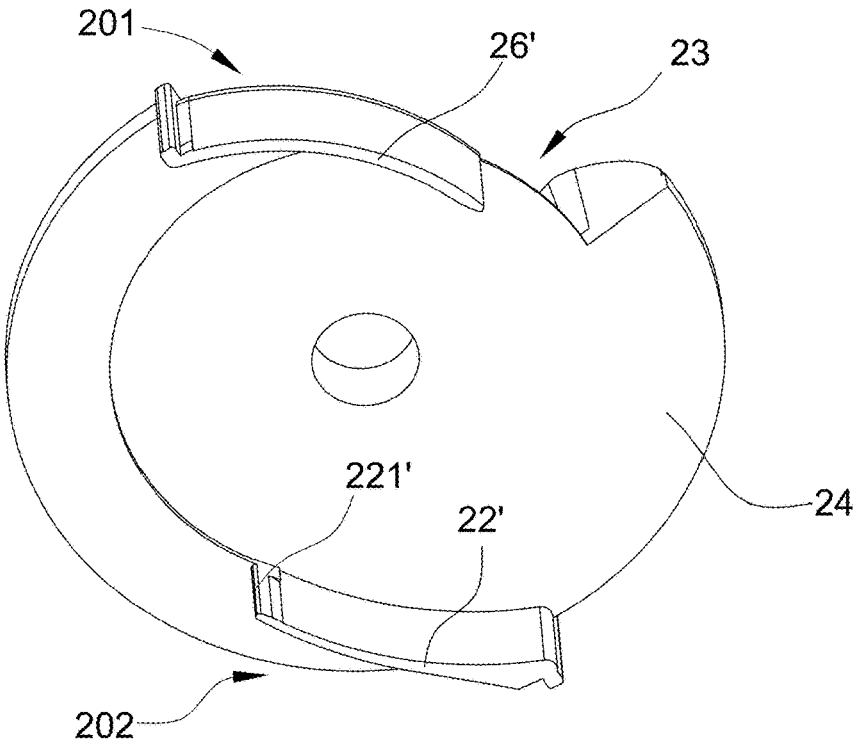
FIG. 15 is another perspective view of FIG. 14 seen from a bottom of the bottom of the cover plate.
Figure 16:
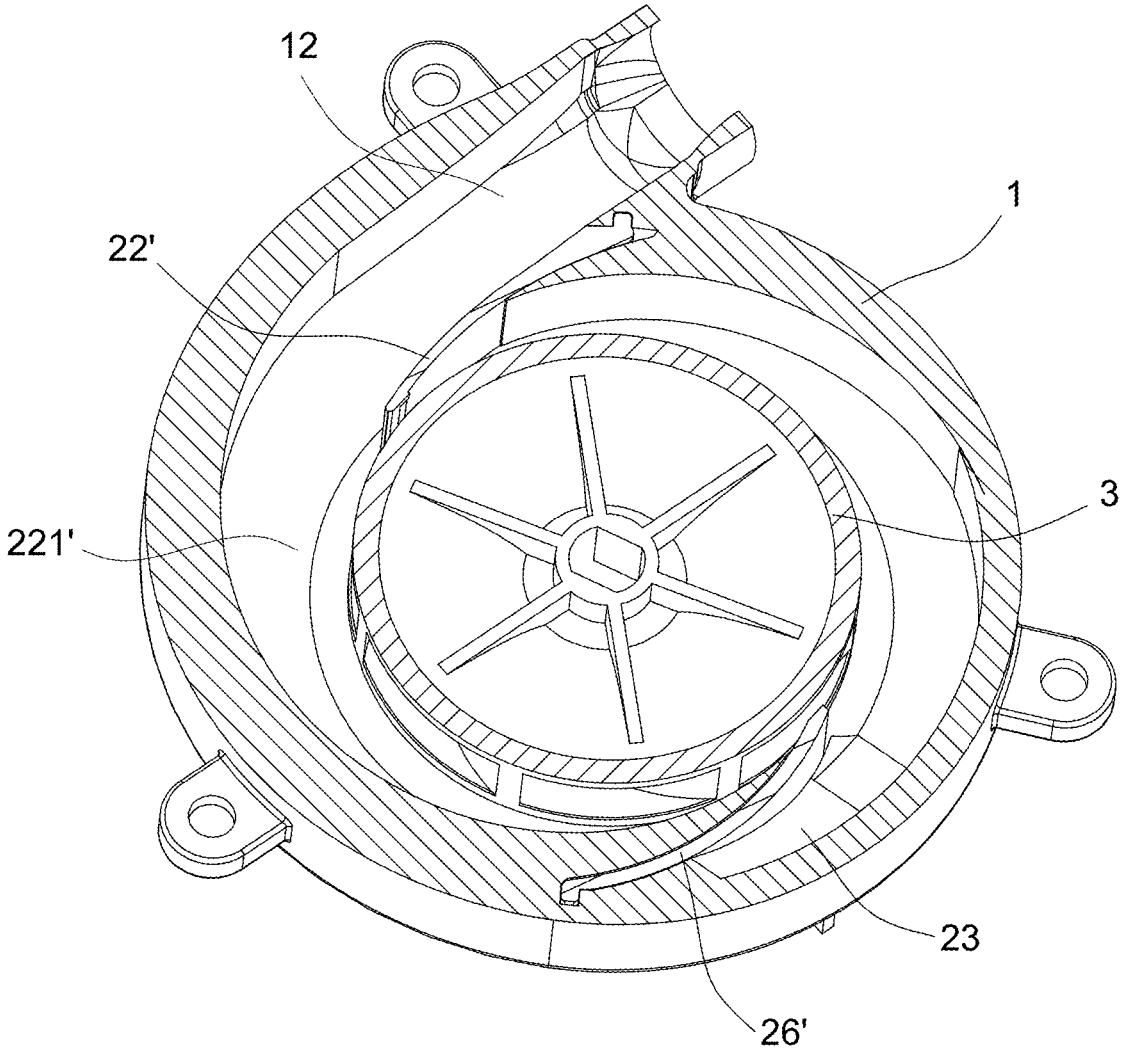
FIG. 16 is a transverse sectional view of a volute, a guide vane and a centrifugal impeller according to Embodiment 2 of the present invention.

As shown in FIGS. 14-16, the water flow system of Embodiment 2 differs from Embodiment 1 in that: only one water guide groove 23 is formed at an edge of the cover plate 24, the cover plate 24 is divided into a first portion 201 and a second portion 202 located at a lower surface of the cover plate 24, only one flow guide piece 26' (which can be regarded as a "first flow guide piece" in this embodiment) is arranged adjacent to the water guide groove 23 at the first portion 201 of the cover plate 24; and a fourth flow guide piece 22' (this component name is only used for distinguishing from the three flow guide pieces in Embodiment 1, and the fourth flow guide piece 22' may be regarded as a "second flow guide piece" in this embodiment) is arranged at the second portion 202 of the cover plate 24, an outer end of the fourth flow guide piece 22' is located adjacent to the edge of the cover plate 24, to form a water division outlet 221' which communicates with the second water outlet 12.

The fourth flow guide piece 22' being located at the second portion 202 of the cover plate 24 extends downwards from the bottom of the cover plate 24, and extends spirally inwards from the edge of the cover plate 24 against the direction of the water flow.

In this way, a first flow guide channel G1 is defined upon the outer side of the first flow guide piece 26', the water guide groove 23, and the upper chamber 21 enclosed together, and a second flow guide channel G2 is defined between the outer side of the fourth flow guide piece 22' and an inner wall of the volute 1 enclosed together.

It should be noted that in the description and claims of the present invention, the terms used to indicate direction, such as "front, back", "up, down", "left, right", "side, top, bottom", etc. are used to describe structures and elements of the present invention for better explanation. And these terms used here are based on an orientation in the accompanying drawings. Since the embodiments disclosed by the present invention can be set in different directions, these terms indicating directions are only used as explanations and should not be used as restrictions. For example, the verbs "up", "down" should not be limited to the direction opposite or consistent with the gravity.

The invention claimed is:

1. A water flow system for a washer, comprising:
- a volute (1) having an inner chamber, a top portion, an annular portion and a bottom portion;
- a guide vane (2) disposed in the chamber of the volute (1) dividing the inner chamber into an upper chamber (21) and a lower chamber (22);
- a centrifugal impeller (3) rotatably disposed in the lower chamber (22);

wherein,
- the volute (1) has a water suction port (13) at the bottom portion of the volute (1), a first water outlet (11) at the top portion of the volute (1), and a second water outlet (12) at the annular portion of the volute (1);
- the first water outlet (11) communicates with the upper chamber (21), the second water outlet (12) communicates with the lower chamber (22), the guide vane (2) has one or more water guide grooves (23) at an outer edge of the guide vane (2) for water to flow from the lower chamber (22) into the upper chamber (21);
- the centrifugal impeller (3) sucks the water below the volute (1) into the lower chamber (22) through the water suction port (13), and then drains the water in the lower chamber (22) into the upper chamber (21) through the water guide grooves (23) and then drains the water in the upper chamber (21) out of the volute (1) through the first water outlet (11);
- the guide vane (2) comprises a circular cover plate (24) and an annular side plate (25) extending downwards from an edge of the cover plate (24), the side plate (25) has an opening (251) at a periphery of the side plate (25) extending along a circumference of the cover plate (24), and the opening (251) of the side plate (25) faces the second water outlet (12), and the one or more water guide grooves (23) are located at the side plate (25) and pass through the cover plate (24).

2. The water flow system of claim 1, wherein the edge of the cover plate (24) of the guide vane (2) is adjacent to an inner wall of the volute (1) to divide the inner chamber of the volute (1) into the upper chamber (21) and the lower chamber (22), the periphery of the side plate (25) is close to the inner wall of the volute (1).

3. The water flow system of claim 1, wherein the second water outlet (12) has a first side edge (121) and a second side edge (122), the side portion of the volute (1) has a pressurizing surface (14) spirally extending from the first side edge (121) to the second side edge (122) in a water flow direction, the opening (251) of the side plate (25) corresponds to the pressurizing surface (14), the pressurizing surface (14) has a starting end and a tail end.

4. The water flow system of claim 3, wherein the volute (1) has a water outlet pipe (15) respectively connected to a tail end of the pressurizing surface (14) and to the second side edge (122) of the second water outlet (12) on the annular portion of the volute (1), the side plate (25) has a first end and a second end, the first end of the side plate (25) is arranged close to the starting end of the pressurizing surface (14), and the second end thereof is arranged close to the second side edge (122) of the second water outlet (12).

5. The water flow system of claim 3, wherein the guide vane (2) further comprises a flow guide piece (26) extending downwards from the cover plate (24) and arranged adjacent to an inner annular wall of the side plate (25), the flow guide piece (26) is opposite the second water outlet (12) on the circumference of the cover plate (24), a distance between an inner side wall of the flow guide piece (26) and the centrifugal impeller (3) increases gradually along the water flow direction, so that the flow guide piece (26) has a pressurizing curved surface (2621) at the inner side wall of the guide piece (26) for pressurizing the water to be drawn out through the second water outlet (12).

6. The water flow system of claim 5, wherein a tail end of the pressurizing curved surface (2621) is adjacent to a starting end of the pressurizing surface (14).

7. The water flow system of claim 1, wherein the guide vane (2) further comprises at least two flow guide pieces (26) connected to an inner annular wall of the side plate (25) and each spirally extending toward an edge of the centrifugal impeller (3) in a direction opposite that of the water flow, and the at least two flow guide pieces (26) are disposed at regular intervals in the circumferential direction of the side plate (25), the water guide groove (23) being formed between two adjacent flow guide pieces (26).

8. The water flow system of claim 7, wherein the flow guide piece (26) has a first end and a second end, the first end of the flow guide piece (26) is connected to the side plate (25), and the second end of the flow guide piece (26) is arranged adjacent to the edge of the centrifugal impeller (3), a distance between the inner side wall of each flow guide piece (26) and the centrifugal impeller (3) spirally increases from the second end of the flow guide piece (26) to the first end of the flow guide piece (26).

9. The water flow system of claim 7, wherein the flow guide piece (26) comprises a first flow guide piece (261) and a second flow guide piece (262), the first flow guide piece (261) is arranged adjacent to the second water outlet (12), the second flow guide piece (262) is opposite the second water outlet (12) on the circumference of the side plate (25), and a distance between a tail end of the first flow guide piece (261) to the edge of the centrifugal impeller (3) is smaller than a distance from a tail end of the second flow guide piece (262) to the edge of the centrifugal impeller (3).

10. The water flow system of claim 9, wherein the flow guide piece (26) further comprises a third flow guide piece (263), the third flow guide piece (263) is located between the first flow guide piece (261) and the second flow guide piece (262), the number of the water guide grooves (23) is two and one of the two water guide grooves (23) is formed between the first flow guide piece (261) and the third flow guide piece (263), the other of the two water guide grooves (23) is formed between the second flow guide piece (262) and the third flow guide piece (263).

11. The water flow system of claim 9, wherein the second end of the side plate (25) is smoothly connected to the tail end of the first flow guide piece (261) through a smooth curved surface (264) having a first end and a second end, the first end of the smooth curved surface (264) and the tail end of the first flow guide piece (261) form a flow diverting end (265) for diverting water, the second end of the smooth curved surface (264) is smoothly connected to the second side edge (122) of the second water outlet (12).

12. The water flow system of claim 7, wherein the volute (1) is cylinder-shaped, the centrifugal impeller (3) is centered inside the volute (1), a lower volute chamber (260) is defined between the flow guide piece (26) and the inner wall of the volute (1), the centrifugal impeller (3) is off center relative to the lower volute chamber (260), and the water guide groove (23) is located closer to the centrifugal impeller (3) and the lower volute chamber (260) than the second water outlet (12) to the centrifugal impeller (3) and the lower volute chamber (260).

13. The water flow system of claim 7, wherein the upstream first end of the upstream flow guide piece (26) and the downstream second end of the flow guide piece (26) are staggered to form a water guide flow channel (231) which communicates with the water guide groove (23), a water outlet end of the water guide flow channel (231) is located at an inside of the side plate (25) and communicates with a first side of the water guide groove (23).

14. The water flow system of claim 13, wherein a second side of the water guide groove (23) has a flow guide slope (232) located corresponding to the water outlet end of the water guide flow channel (231), and the flow guide slope (232) having an upper end and a lower end gradually recedes away from the water outlet end of the water guide flow channel (231) from bottom to top of the flow guide slope (232).

15. The water flow system of claim 14, wherein a baffle (27) extends upward from an upper surface of the cover plate (24), a converging flow channel (270) is defined between the baffle (27) and a top surface of the volute (1), the converging flow channel (270) communicates with the water guide groove (23) and gathers the water which is output upward from the first water outlet (11), an inner side wall of the converging flow channel (270) is close to and smoothly connected to the upper end of the flow guide slope (232).

16. The water flow system of claim 1, wherein a baffle (27) extends upward from an upper surface of the cover plate (24), a converging flow channel (270) is defined between the baffle (27) and a top surface of the volute (1), the converging flow channel (270) communicates with the water guide groove (23) and gathers the water which is output upward from the first water outlet (11).

17. The water flow system of claim 16, wherein the cover plate (24) has a plurality of reinforcing ribs (28) on an upper surface of the cover plate (24), the reinforcing ribs (28) resist against a top surface of a pump housing and are connected to a periphery of the baffle (27).

18. The water flow system of claim 16, wherein the volute (1) has the first water outlet (11) at a central portion of the top surface of the volute (1), the baffle (27) comprises a circular arc segment (271) arranged around an edge of the first water outlet (11), and a first curved surface segment (272) extending smoothly from a first end of the circular arc segment (271) to a first edge of the water guide groove (23), and a second curved surface segment (273) extending smoothly from a second end of the circular arc segment to a second edge of the water guide groove (23).

19. The water flow system of claim 1, wherein the water flow system further comprises a first spraying arm (4) having a bottom end, the first spraying arm (4) has a water inlet (41) and a water inlet sleeve (42) extending downward from an edge of the water inlet (41), the volute (1) has a water outlet sleeve (16) extending upward from an edge of the first water outlet (11), and the water inlet sleeve (42) is rotatably inserted into the water outlet sleeve (16).

20. The water flow system of claim 19, wherein the water flow system further comprises a second spraying arm (5) arranged above the first spraying arm (4), a water inlet end of the second spraying arm (5) communicates with the second water outlet (12) of the volute (1) through a water delivery pipeline (6).

21. A washer, comprising:

a box body (8), the first spraying arm (4), the second spraying arm (5) and the water flow system of claim 20;

wherein, the box body (8) has a water-returning recess (81) at a bottom portion of the box body (8), the recess (81) has a top portion and a bottom portion, the top portion of the recess (81) is covered with a filter plate (82), the volute (1) is arranged inside the recess (81), a water suction gap is formed between the water suction port (13) and the bottom portion of the recess (81), the first water outlet (11) at the top portion of the volute (1) is located above the filter plate (82) and communicates with the water inlet (41) of the first spraying arm (4), and the second spraying arm (5) is arranged in an upper portion of the box body (8) and communicates with the second water outlet (12) of the volute (1) through the water delivery pipeline (6).

22. The water flow system of claim 1, wherein the water flow system further comprises a driving member (7) arranged below the volute (1), a power output shaft (71) of the driving member (7) passes through the water suction port (13) to connect to the centrifugal impeller (3).

23. A water flow system for washer, comprising a volute having an inner chamber and a centrifugal impeller for drawing water;

wherein, the water flow system further comprises a guide vane, the volute has a water suction port at a bottom portion of the volute, a first water outlet at a top portion of the volute, and a second water outlet at an annular portion of the volute, the guide vane is arranged inside the volute and has a first flow guide channel capable of guiding a water to the first water outlet, and a second flow guide channel capable of guiding the water to the second water outlet;

the guide vane comprises a cover plate transversely arranged in a middle of the volute, the guide vane divides the inner chamber of the volute into an upper chamber and a lower chamber independent from each other, the first flow guide channel passes through the lower chamber, an edge of the cover plate and the upper chamber, the second flow guide channel is formed inside the lower chamber; and the cover plate is divided into at least a first portion and a second portion which are connected to each other, the edge of the cover plate is partially uncovered at a position corresponding to the first portion to form a water guide groove for the lower chamber to communicate with the upper chamber, and the water guide groove is a part of the first flow guide channel.

24. The water flow system of claim 23, wherein at least two first flow guide pieces arranged to correspond to the first portion of the cover plate are located at a lower surface of the cover plate, a water guiding flow channel is defined between the two first flow guide pieces, the water guide groove is arranged corresponding to an outer end of the water guiding flow channel, and the water guiding flow channel, the water guide groove and the upper chamber together enclose the first flow guide channel.

25. The water flow system of claim 23, wherein the second water outlet communicates with the lower chamber, and the second flow guide channel is formed between an edge of the second portion of the cover plate and the second water outlet.

26. The water flow system of claim 23, wherein a second flow guide piece corresponding to the second portion of the cover plate is arranged on the lower surface of cover plate, and an outer end of the second flow guide piece is located within the edge of the cover plate, forming a water guiding outlet which communicates with the second water outlet.

27. The water flow system of claim 26, wherein a first flow guide channel is defined upon the outer side of the first flow guide piece, the water guide groove, and the upper chamber enclosed together, and a second flow guide channel is defined between the outer side of the second flow guide piece and an inner wall of the volute enclosed together.

28. A water flow system for a washer, comprising:

a volute (1) having an inner chamber, a top portion, an annular portion and a bottom portion;

a guide vane (2) disposed in the chamber of the volute (1) dividing the inner chamber into an upper chamber (21) and a lower chamber (22);

a centrifugal impeller (3) rotatably disposed in the lower chamber (22);

wherein, the volute (1) has a water suction port (13) at the bottom portion of the volute (1), a first water outlet (11) at the top portion of the volute (1), and a second water outlet (12) at the annular portion of the volute (1);

the first water outlet (11) communicates with the upper chamber (21), the second water outlet (12) communicates with the lower chamber (22), the guide vane (2) has one or more water guide grooves (23) at an outer edge of the guide vane (2) for water to flow from the lower chamber (22) into the upper chamber (21);

the centrifugal impeller (3) sucks the water below the volute (1) into the lower chamber (22) through the water suction port (13), and directly drains the water in the lower chamber (22) out of the volute (1) through the second water outlet (12);

the guide vane (2) comprises a circular cover plate (24) and an annular side plate (25) extending downwards from an edge of the cover plate (24), the side plate (25) has an opening (251) at a periphery of the side plate (25) extending along a circumference of the cover plate (24), and the opening (251) of the side plate (25) faces the second water outlet (12), and the one or more water guide grooves (23) are located at the side plate (25) and pass through the cover plate (24).

* * * * *